US010396427B2

(12) United States Patent
Talty et al.

(10) Patent No.: US 10,396,427 B2
(45) Date of Patent: Aug. 27, 2019

(54) DUAL POLARIZED WIDEBAND LTE THIN FILM ANTENNA

(71) Applicant: GM GLOBAL TECHNOLOGY OPERATIONS LLC, Detroit, MI (US)

(72) Inventors: Timothy J. Talty, Beverly Hills, MI (US); Keerti S. Kona, Woodland Hills, CA (US); Hyok Jae Song, Oak Park, CA (US); Amit M. Patel, Santa Monica, CA (US); James H. Schaffner, Chatsworth, CA (US); Duane S. Carper, Davison, MI (US); Eray Yasan, Canton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 68 days.

(21) Appl. No.: 15/583,204

(22) Filed: May 1, 2017

(65) Prior Publication Data

US 2017/0324139 A1 Nov. 9, 2017

Related U.S. Application Data

(60) Provisional application No. 62/332,611, filed on May 6, 2016.

(51) Int. Cl.

| | |
|---|---|
| ***H01Q 1/12*** | (2006.01) |
| ***H01Q 1/48*** | (2006.01) |
| ***H01Q 21/24*** | (2006.01) |
| ***H01Q 9/04*** | (2006.01) |

(Continued)

(52) U.S. Cl.

CPC ..... *H01Q 1/1271* (2013.01); *H01Q 1/48* (2013.01); *H01Q 9/0485* (2013.01); *H01Q 13/20* (2013.01); *H01Q 21/24* (2013.01); *H01Q 21/28* (2013.01)

(58) Field of Classification Search

CPC ..... H01Q 1/1271; H01Q 1/48; H01Q 9/0485; H01Q 13/20; H01Q 21/24; H01Q 21/28

See application file for complete search history.

(56) References Cited

U.S. PATENT DOCUMENTS 5,355,144 A * 10/1994 Walton ..... B32B 17/10036 343/713

5,760,744 A * 6/1998 Sauer ..... B32B 17/10036 29/600

(Continued)

OTHER PUBLICATIONS

Yahya et al., "Design of a New Dual-polarized Ultra-wideband Planar CPW Fed Antenna", IEEE Transactions on Communications (Year: 2011).*

(Continued)

*Primary Examiner* — Dieu Hien T Duong
*Assistant Examiner* — Bamidele A Jegede
(74) *Attorney, Agent, or Firm* — Cantor Colburn LLP

(57) ABSTRACT

A thin film, flexible, co-planar waveguide (CPW), dual-polarized antenna structure suitable to be mounted on vehicle glass and that has particular application for MIMO LTE applications in the frequency band of, for example, 0.46-3.8 GHz. The antenna structure includes two U-shaped antenna radiating elements that receive signals that are linearly polarized in two orthogonal horizontal (H) and vertical (V) directions, where the radiating elements are separated by a ground plane line.

22 Claims, 2 Drawing Sheets

(51) Int. Cl.
*H01Q 13/20* (2006.01)
*H01Q 21/28* (2006.01)

(56) References Cited

U.S. PATENT DOCUMENTS 6,097,345 A * 8/2000 Walton ..... H01Q 1/1271 343/700 MS
6,157,344 A * 12/2000 Bateman ..... G06F 1/1616 343/700 MS
2002/0122010 A1* 9/2002 McCorkle ..... H01Q 9/40 343/767
2003/0034926 A1* 2/2003 Veerasamy ..... H01Q 1/1271 343/713
2005/0052334 A1* 3/2005 Ogino ..... H01Q 1/1271 343/866
2006/0202898 A1* 9/2006 Li ..... H01Q 1/1271 343/713
2007/0040756 A1* 2/2007 Song ..... H01Q 1/1271 343/713
2009/0128431 A1* 5/2009 Martin ..... B32B 17/10036 343/713
2009/0140938 A1* 6/2009 Ishibashi ..... H01Q 1/1271 343/713
2011/0221652 A1* 9/2011 Li ..... H01Q 1/1271 343/860
2012/0154229 A1* 6/2012 Kagaya ..... H01Q 1/1271 343/713
2013/0113664 A1* 5/2013 Kobayashi ..... H01Q 1/1271 343/711
2013/0257664 A1* 10/2013 Kagaya ..... H01Q 1/1271 343/713
2013/0285861 A1* 10/2013 Kagaya ..... H01Q 1/1271 343/712
2014/0015716 A1* 1/2014 Villarroel ..... H01Q 1/1271 343/713
2014/0104122 A1* 4/2014 Lee ..... H01Q 1/1271 343/713
2014/0139399 A1* 5/2014 Miyake ..... H01Q 1/521 343/893
2014/0332519 A1* 11/2014 Sakamoto ..... B60J 1/02 219/203
2015/0222010 A1* 8/2015 Dai ..... H01Q 1/50 343/713
2016/0013539 A1* 1/2016 Shkembi ..... H01Q 1/3291 343/713
2016/0013839 A1 1/2016 Song et al.

OTHER PUBLICATIONS

Daviu et al. "Novel Ultra-Wideband antenna for Diversity Application", IEEE Antennas and Propagation Society International Symposium 2010 (Year: 2010).*
Mouffok, Lila, et al. "Compact Dual-Band Dual-Polarized Antenna for MIMO LTE Applications" International Journal of Antennas and Propagation, France, vol. 2012, Article ID 398423, 10 pgs. 2012.
Yahya, Rabia et al. "Design of a New Dual-Polarized Ultra-Wideband Planar CPW Fed Antenna" Antennas and Propagation, 2011 IEEE International Symposium, IEEE Xplore, Conference Jul. 3-8, 2011.

* cited by examiner

DUAL POLARIZED WIDEBAND LTE THIN FILM ANTENNA

CROSS-REFERENCE TO RELATED APPLICATIONS

This application claims the benefit of the priority date of U.S. Provisional Patent Application Ser. No. 62/332,611, titled, Dual Polarized Wideband LTE Thin Film Antenna, filed May 6, 2016.

BACKGROUND OF THE INVENTION

Field of the Invention

This invention relates generally to a dual-polarized, thin film antenna structure and, more particularly, to a dual-polarized, wideband, thin film antenna structure including two U-shaped antenna radiating elements that provide for multiple-input multiple-output (MIMO) long term evolution (LTE) 4G cellular applications, where the antenna structure can be effectively adhered to vehicle glass.

Discussion of the Related Art

Modern vehicles employ various and many types of antennas to receive and transmit signals for different communications systems, such as terrestrial radio (AM/FM), cellular telephone, satellite radio, dedicated short range communications (DSRC), GPS, etc. Further, cellular telephone is expanding into 4G long term evolution (LTE) that requires two antennas to provide multiple-input multiple-output (MIMO) operation. The antennas used for these systems are often mounted to a roof of the vehicle so as to provide maximum reception capability. Further, many of these antennas are often integrated into a common structure and housing mounted to the roof of the vehicle, such as a "shark-fin" roof mounted antenna module. As the number of antennas on a vehicle increase, the size of the structures required to house all of the antennas in an efficient manner and providing maximum reception capability also increases, which interferes with the design and styling of the vehicle. Because of this, automotive engineers and designers are looking for other suitable areas on the vehicle to place antennas that may not interfere with vehicle design and structure.

One of those areas is the vehicle glass, such as the vehicle windshield, which has benefits because glass typically makes a good dielectric substrate for an antenna. For example, it is known in the art to print AM and FM antennas on the glass of a vehicle where the printed antennas are fabricated within the glass as a single piece. However, those known systems are generally limited in that they could only be placed in a vehicle windshield or other glass surface in areas where viewing through the glass was not necessary.

As mentioned, the current state of the art for mobile cellular wireless communications technology is known as 4G, which provides greater data throughput and bandwidth than previous cellular communications technologies, such as 2G and 3G. LTE 4G cellular technology employs MIMO antennas at the transmitter and the receiver that provide an increase in the number of signal paths between the transmitter and the receiver, including multipath reflections off of various objects between the transmitter and the receiver, which allows for the greater data throughput. As long as the receiver can decouple the data being received on each path at the MIMO antennas where the signals are uncorrelated, then those paths can be used by the receiver to decipher data transmitted at the same frequency and at the same time. Thus, more data can be compressed into the same frequency providing higher bandwidth.

Automobile manufacturers are looking to provide 4G cellular technology in vehicles, which presents a number of design challenges especially if the MIMO antennas are incorporated as part of a common antenna structure mounted to the roof of the vehicle. For example, by housing the MIMO antennas, which include at least two antennas, in the traditional telematics antenna module mounted to the roof of the vehicle, the entire antenna volume of the module would need to increase because of the extra real estate required for the MIMO antennas, which require a low correlation of the received signals at the antennas. In other words, because the signals received by the MIMO antennas need to be significantly uncorrelated, the distance between the antennas needs to be some minimum distance depending on the frequency band being employed. This de-correlation between the antenna ports is often times difficult to achieve in various designs if the antenna elements are located at the same general location because the signals received at the port would be very similar. This problem can be overcome by moving the antennas farther apart. Due to the increased size and volume of the antenna module, the required packaging for the MIMO antennas may no longer meet the styling and other requirements of the vehicle.

For MIMO LTE cellular systems, polarization diversity and multiplexing is one of the techniques employed to increase spectral efficiency and improve LTE signal link quality. Spatial multiplexing provides significant improvement in a non-line-of-sight environment because the spatial correlation among multiple propagation channels is low. However, using polarization diversity for MIMO operations with dual-polarized antenna promises to be a more effective method in a line-of-sight environment with outdoor conditions for vehicle applications.

SUMMARY OF THE INVENTION

The present invention discloses and describes a thin film, flexible, co-planar waveguide (CPW), dual-polarized antenna structure suitable to be mounted on vehicle glass and that has particular application for MIMO LTE applications in the frequency band of, for example, the 0.46-3.8 GHz. The antenna structure includes two U-shaped antenna radiating elements that receive signals that are linearly polarized in two orthogonal horizontal (H) and vertical (V) directions, where the radiating elements are separated by a ground plane line.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a thin film, flexible, CPW, dual-polarized antenna structure including two antenna radiating elements applicable for a MIMO LTE system and being suitable to be adhered to a curved dielectric structure is merely exemplary in nature, and is in no way intended to limit the invention or its applications or uses. For example, the discussion herein talks about the antenna structure being applicable to be adhered to automotive glass. However, as will be appreciated by those skilled in the art, the antenna structure will have application for other dielectric structures other than automotive structures and other than transparent or translucent surfaces.

Figure 1:
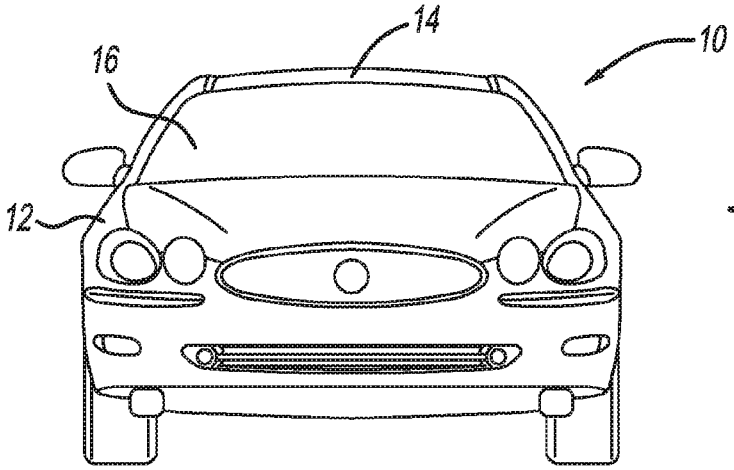
FIG. 1 is front view of a vehicle showing a vehicle windshield.
Figure 2:
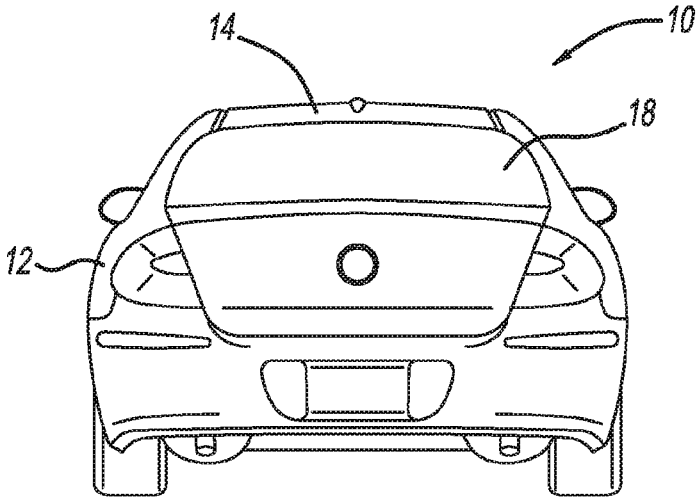
FIG. 2 is a rear view of the vehicle showing a vehicle rear window.

FIG. 1 is a front view of a vehicle 10 including a vehicle body 12, roof 14 and windshield 16, and FIG. 2 is a rear view of the vehicle 10 showing a rear window 18.

As will be discussed in detail below, the present invention proposes providing a thin film, flexible, wideband, CPW antenna structure mountable on the windshield 16, the rear window 18, or any other window or dielectric substrate on the vehicle 10, where the antenna structure is flexible to conform to the shape of the particular dielectric substrate, and where the antenna structure can be mounted at any suitable location on the dielectric substrate, including locations on the windshield 16 that the vehicle driver needs to see through. The antenna structure has particular application for MIMO LTE applications in the frequency range of, for example, 0.46-3.8 GHz, and includes two U-shaped antenna radiating elements that are linearly polarized in two orthogonal horizontal (H) and vertical (V) directions. In one embodiment, the antenna structure is a wideband monopole appliqué antenna that is installed directly on the surface of the dielectric structure by a suitable adhesive. The antenna structure can be designed to operate on automotive glass of various physical thicknesses and dielectric properties, where the antenna structure operates as intended when installed on the glass or other dielectric since in the design process the glass or other dielectric is considered in the antenna geometry pattern development.

Figure 3:
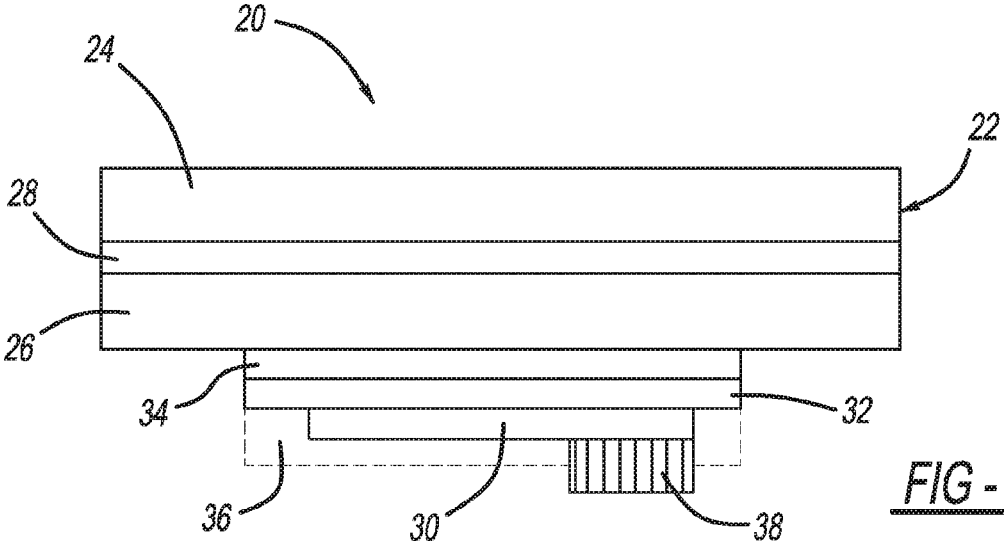
FIG. 3 is a profile view of a vehicle window including a thin, flexible CPW antenna structure formed thereon.

FIG. 3 is a profile view of an antenna structure 20 including a glass substrate 22, such as a vehicle windshield, having an outer glass layer 24, an inner glass layer 26 and a polyvinyl butyral (PVB) layer 28 therebetween. The structure 20 also includes a printed CPW antenna 30 formed on a thin, flexible film substrate 32, such as polyethylene terephthalate (PET), biaxially-oriented polyethylene terephthalate (BoPET), flexible glass substrates, mylar, Kapton, etc., and adhered to a surface of the layer 26 by an adhesive layer 34. The adhesive layer 34 can be any suitable adhesive or transfer tape that effectively allows the substrate 32 to be secured to the glass layer 26, and further, if the antenna 30 is located in a visible area of the glass layer 26, the adhesive or transfer tape can be transparent or near transparent so as to have a minimal impact on the appearance and light transmission therethrough. The antenna 30 can be protected by a low RF loss passivation layer 36, such as parylene. An antenna connector 38 is shown connected to the antenna 30 and can be any suitable RF or microwave connector, such as a direct pig-tail or coaxial cable connection. Although the antenna 30 is shown being coupled to an inside surface of the inner glass layer 26, the antenna 30 can be adhered to the outer surface of the outer glass layer 24 or the surface of the layers 24 or 26 adjacent to the PVB layer 28 or the surfaces of the PVB layer 28.

The antenna 30 can be formed by any suitable low loss conductor, such as copper, gold, silver, silver ceramic, metal grid/mesh, etc. If the antenna 30 is at a location on the vehicle glass that requires the driver or other vehicle occupant to see through the glass, then the conductor can be any suitable transparent conductor, such as indium tin oxide (ITO), silver nano-wire, zinc oxide (ZnO), etc. Performance of the antenna 30 when it is made of a transparent conductor could be enhanced by adding a conductive frame along the edges of the antenna 30 as is known in the art.

The thickness of automotive glass may vary approximately over 2.8 mm-5 mm and may have a relative dielectric constant $\varepsilon_r$ in the range of 4.5-7.0. The antenna 30 includes a single layer conductor and a co-planar waveguide (CPW) feed structure to excite the antenna radiator. The CPW feed structure can be configured for mounting the connector 38 in a manner appropriate for the CPW feed line or for a pigtail or a coaxial cable. When the connector 38 or the pigtail connection to the CPW line is completed, the antenna 30 can be protected with the passivation layer 36. In one embodiment, when the antenna 30 is installed on the glass layer 26, a backing layer of the transfer tape can be removed. By providing the antenna conductor on the inside surface of the vehicle windshield 22, degradation of the antenna 30 can be reduced from environmental and weather conditions.

In one specific embodiment, the antenna 30 is a dual-polarized MIMO LTE antenna that employs orthogonal vertical (V) and horizontal (H) polarized signals having good isolation between the two polarizations that potentially establishes lower channel correlation. The antenna 30 is a co-planar slot type wideband antenna covering the LTE band from 0.46-3.8 GHz. The antenna 30 includes a circular slot that is excited by two orthogonal U-shaped monopoles fed through tapered CPW lines that are patterned into a single layer flexible PCV substrate. The currents on the slots fed by the CPW signal strip mainly contribute to the wideband frequency response. The center strips and circular patch at the center provide an improved isolation between the two antenna ports, thus providing better polarization isolation. The fabricated antenna can be installed on to the vehicle glass by applying a dielectric adhesive on the non-conductive side of the antenna and pressing the antenna against the glass.

Figure 4:
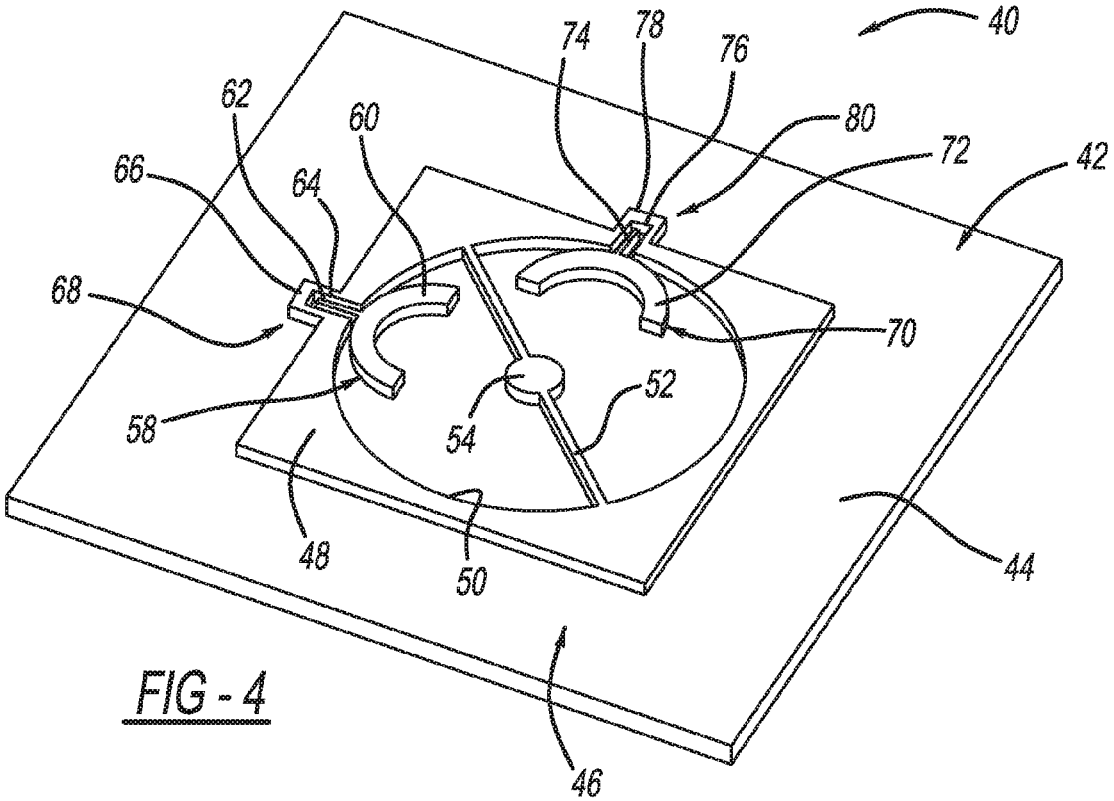
FIG. 4 is an isometric view of a dual-polarized, wideband, thin film antenna structure configured on a transparent substrate.

FIG. 4 is an isometric view of a dual-polarized, thin film, CPW antenna structure 40 of the type discussed above including a transparent dielectric substrate 42 representing, for example, automotive glass, including a surface 44 that can be either an inside surface or an outside surface of the substrate 42. The antenna structure 40 also includes a printed antenna 46 formed to the surface 44 of the substrate 42 in the configuration as discussed herein. For the application being discussed herein, where the substrate 42 would be automotive glass, the antenna 46 would be printed on a clear substrate, such as the substrate 32, and be adhered to the substrate 42 by an adhesive layer, such as the adhesive layer 34, which are not shown in FIG. 4 for clarity purposes. The antenna 46 includes a printed planar ground plane 48 that has a general square configuration with a circular cut-out slot 50 therein. In one non-limiting embodiment for the frequency band and the application being discussed herein, the ground plane 48 is a 265 mm square. The ground plane 48 includes a ground line 52 extending across the slot 50 that has a central circular portion 54, as shown, to provide signal separation as will be discussed in detail below.

The antenna structure 40 includes a first printed antenna radiating element 58 having a U-shaped radiating portion 60 that extends into the slot 50 along one side of the plane 48 and on one side of the ground line 52. The radiating element 58 also includes a signal feed line 62 coupled to the radiating portion 60 and extending into a slot 64 formed in a ground portion 66 of a CPW feed structure 68, where the ground portion 66 is part of the ground plane 48. Likewise, the antenna structure 40 includes a second printed antenna radiating element 70 having a U-shaped radiating portion 72 that extends into the slot 50 along an orthogonal side of the plane 48 to the side that the radiating portion 72 extends and on an opposite side of the ground line 52. The radiating element 70 also includes a signal feed line 74 coupled to the radiating portion 72 and extending into a slot 76 formed in a ground portion 78 of a CPW feed structure 80, where the ground portion 78 is part of the ground plane 48. In this embodiment, the U-shaped antenna elements 58 and 70 are elliptical in nature, and have a particular size for the frequency band being discussed herein.

As discussed above, the antenna 46 is dual-polarized in the V and H orthogonal polarization directions. Further, the ground line 52 provides isolation between the two polarizations. The signals received by the antenna 46 create currents along the ground line 52 and in the circle portion 54 that provide isolation for the ports or the signal lines 62 and 74 of the antenna elements 58 and 70, respectively.

Figure 5:
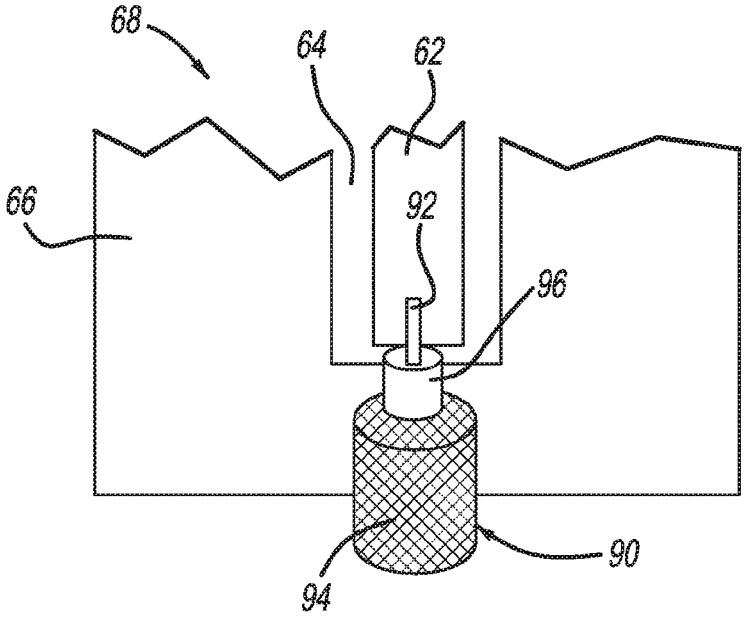
FIG. 5 is an illustration of a CPW antenna feed structure for one of the antenna radiating elements shown in FIG. 4.

Any suitable feed structure can be employed for feeding the antenna radiating elements 58 and 70. FIG. 5 is a top, cut-away view of the CPW antenna feed structure 68 showing one suitable example. In this embodiment, a coaxial cable 90 provides the signal line coupled to the feed structure 68 and includes an inner conductor 92 electrically coupled to the signal line 62 and an outer ground conductor 94 electrically coupled to the ground portion 66, where the conductors 92 and 94 are separated by an insulator 96.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna structure comprising: a dielectric structure;

a thin film substrate adhered to the dielectric structure by an adhesive layer; and a planar antenna formed on the substrate opposite to the adhesive layer, said planar antenna including a ground plane that is generally rectangular in shape and includes a cut-out slot section defined within an outer perimeter portion of the ground plane, said ground plane including a conductive line extending continuously across from a first side to a second side of the slot section, the conductive line having a centrally located circular portion, said antenna further including a first U-shaped antenna radiating element extending into the slot section from one side of the perimeter portion and being on one side of the conductive line and a second U-shaped antenna radiating element extending into the slot section from an orthogonal side of the perimeter portion and being on an opposite side of the conductive line, wherein the conductive line is sized and positioned to isolate a first polarization and a second polarization of the antenna, the first polarization and second polarization having orthogonal directions to each other.

2. The antenna structure according to claim 1 wherein the ground plane includes a circular portion positioned within the slot section and being electrically part of the conductive line.

3. The antenna structure according to claim 1 further comprising a first feed structure being electrically coupled to the perimeter portion and the first antenna element and a second feed structure being electrically coupled to the perimeter portion and the second antenna element.

4. The antenna structure according to claim 3 wherein the first and second feed structures are co-planar waveguide structures.

5. The antenna structure according to claim 4 further comprising a coaxial connector connected to the first and second co-planar waveguide feed structures.

6. The antenna structure according to claim 1 wherein the perimeter portion is square.

7. The antenna structure according to claim 6 wherein each side of the perimeter portion is about 265 mm.

8. The antenna structure according to claim 1 wherein the first and second U-shaped antenna radiating elements are elliptical.

9. The antenna structure according to claim 1 wherein the cut-out slot section is circular.

10. The antenna structure according to claim 1 wherein the antenna structure is a dual-polarized antenna structure in the orthogonal vertical and horizontal directions.

11. The antenna structure according to claim 1 wherein the dielectric structure is a vehicle window.

12. The antenna structure according to claim 11 wherein the vehicle window is a vehicle windshield.

13. The antenna structure according to claim 1 wherein the antenna includes transparent conductors.

14. The antenna structure according to claim 1 wherein the thin film substrate is selected from the group consisting of mylar, Kapton, PET and flexible glass substrates.

15. The antenna structure according to claim 1 wherein the first antenna element and the second antenna element operate in the same frequency band and provide signals for a multiple-input multiple output (MIMO) long term evolution (LTE) cellular system.

16. The antenna structure according to claim 15 wherein the frequency band is in the range of 0.46-3.8 GHz.

17. The antenna structure according to claim 1 wherein the dielectric structure has an outer layer and an inner layer with a polyvinyl butyral (PVB) layer between the inner layer and the outer layer, the thin film substrate adhered to the inner layer.

18. The antenna structure according to claim 17 wherein the thin film substrate is adhered to an interior surface of the inner layer of the dielectric structure.

19. An antenna structure that is a dual-polarized antenna structure in the orthogonal vertical and horizontal directions, said antenna structure comprising:

a vehicle window;

a thin film substrate adhered to the vehicle window by an adhesive layer; and a planar antenna formed on the substrate opposite to the adhesive layer, said planar antenna including a ground plane that is generally rectangular in shape and includes a cut-out slot section defined within an outer perimeter portion of the ground plane, said ground plane including a conductive line extending continuously across from a first side to a second side of the slot section, the conductive line having a centrally located circular portion, said antenna further including a first U-shaped antenna radiating element extending into the slot section from one side of the perimeter portion and being on one side of the conductive line and a second U-shaped antenna radiating element extending into the slot section from an orthogonal side of the perimeter portion and being on an opposite side of the conductive line, wherein the conductive line is sized and positioned to isolate a first polarization and a second polarization of the antenna, the first polarization and second polarization having orthogonal directions to each other, and wherein the first antenna element and the second antenna element operate in the same frequency band and provide signals for a multiple-input multiple output (MIMO) long term evolution (LTE) cellular system.

20. The antenna structure according to claim 19 wherein the vehicle window is a vehicle windshield.

21. The antenna structure according to claim 19 wherein the antenna includes transparent conductors.

22. An antenna structure that is a dual-polarized antenna structure in the orthogonal vertical and horizontal directions, said antenna structure comprising:

a dielectric structure;

a thin film substrate adhered to the dielectric structure by an adhesive layer; and a planar antenna formed on the substrate opposite to the adhesive layer, said planar antenna including a ground plane that is generally rectangular in shape and includes a circular cut-out slot section defined within an outer perimeter portion of the ground plane, said ground plane including a conductive line extending continuously across from a first side to a second side of the slot section, the conductive line having a centrally located circular portion, said antenna further including a first elliptical U-shaped antenna radiating element extending into the slot section from one side of the perimeter portion and being on one side of the conductive line and a second elliptical U-shaped antenna radiating element extending into the slot section from an orthogonal side of the perimeter portion and being on an opposite side of the conductive line, wherein the conductive line is sized and positioned to isolate a first polarization and a second polarization of the antenna, the first polarization and second polarization having orthogonal directions to each other.

* * * * *